United States Patent [19]

Sentoku

[11] 4,392,504

[45] Jul. 12, 1983

[54] STACKING CYLINDER FOR USE IN A COIN HANDLING MACHINE

[75] Inventor: Hideshi Sentoku, Tokyo, Japan

[73] Assignee: Laurel Bank Machine Co., Ltd., Tokyo, Japan

[21] Appl. No.: 165,718

[22] Filed: Jul. 3, 1980

[30] Foreign Application Priority Data

Jul. 6, 1979 [JP] Japan ..... 54-93801[U]
Jul. 6, 1979 [JP] Japan ..... 54-93802[U]

[51] Int. Cl.[3] ..... G07D 9/06
[52] U.S. Cl. ..... 133/1 A; 53/254
[58] Field of Search ..... 133/1 A, 8 A; 53/212, 53/213, 254; 29/451, 234

[56] References Cited

U.S. PATENT DOCUMENTS

| | | | |
|---|---|---|---|
| 1,274,615 | 8/1918 | Sherwood | 133/1 A X |
| 2,005,577 | 6/1935 | Dowd | 29/234 X |
| 3,598,129 | 8/1971 | Itoda | 133/1 A |
| 3,828,415 | 8/1974 | Kammeraad et al. | 29/451 X |

*Primary Examiner*—F. J. Bartuska
*Attorney, Agent, or Firm*—Fleit, Jacobson & Cohn

[57] ABSTRACT

There is provided a stacking cylinder for use in a coin handling machine. The stacking cylinder is provided at the top portion thereof with a guide member for guiding coins in a certain direction so as to prevent coins from interfering with each other and thereby to correctly stack coins in the stacking cylinder. The stacking cylinder is assembled by inserting a resilient metal sheet into a cylindrical recess formed inside of the cylinder body without adhesive.

4 Claims, 7 Drawing Figures

STACKING CYLINDER FOR USE IN A COIN HANDLING MACHINE

BACKGROUND OF THE INVENTION

This invention relates to improvements in a stacking cylinder for use in a coin handling machine such as a coin wrapping machine.

In conventional coin wrapping machines, coins are transferred by a belt within a coin path and then through a chute into a stacking cylinder where they are vertically stacked. Although the chute is arranged above the stacking cylinder so that it directs the coins into the stacking cylinder, it cannot sufficiently direct all coins toward the bottom of the stacking cylinder in a certain direction. Therefore, it often occurs that during the dropping of the coins one coin strikes onto one portion of the inner surface of the stacking cylinder and then is rebounded from the portion to the other opposite portion of the inner surface while a subsequent coin may directly drop toward the bottom of the stacking cylinder. In such a case, the two coins interfere with each other and become jammed in the intermediate portion of the stacking cylinder.

Further, in conventional coin wrapping machines, the stacking cylinder comprises an outer main cylinder body made of a synthetic resin and an inner member made of a cylindrical metal sheet attached by adhesive to the main body. The metal sheet provides a smooth dropping surface for the coins and protects the main body from wear and dust. However it is rather difficult to make a metal sheet accurately cylindrical and to cleanly attach the metal sheet to the main body by adhesive. The adhesive is liable to flow out from between the metal sheet and the main cylinder body. This results in patches of adhesive appearing on the inner surfaces of the metal sheet and the main cylinder body, which prevent the coins from dropping smoothly.

SUMMARY OF THE INVENTION

It is, therefore, an object of the invention to provide a stacking cylinder for use in a coin handling machine in which a guide member is provided for guiding coins in a certain direction toward the bottom of the stacking cylinder so as to stack the coins in the stacking cylinders correctly.

It is another object of the invention to provide a stacking cylinder for use in a coin handling machine in which the stacking cylinder can be manufactured easily.

According to the invention, there is provided a stacking cylinder for use in a coin handling machine wherein coins are introduced through a chute into a stacking cylinder and stacked therein, the improvement characterized in that the stacking cylinder is provided at the top portion thereof with a guide member for guiding coins in a certain direction toward the bottom of the stacking cylinder.

In another aspect of the invention, there is provided a stacking cylinder for use in a coin handling machine wherein coins are introduced into a stacking cylinder and stacked therein, the improvement characterized in that the stacking cylinder is assembled by inserting a resilient metal sheet into a cylindrical recess formed inside of the cylinder body without adhesive.

DESCRIPTION OF THE DRAWINGS

Other objects and advantages of the present invention will become apparent from the following description made with reference to the accompanying drawings, in which.

DESCRIPTION OF THE PREFERRED EMBODIMENTS

Embodiments of the present invention will be now described in detail with reference to the accompanying drawings.

Figure 1:
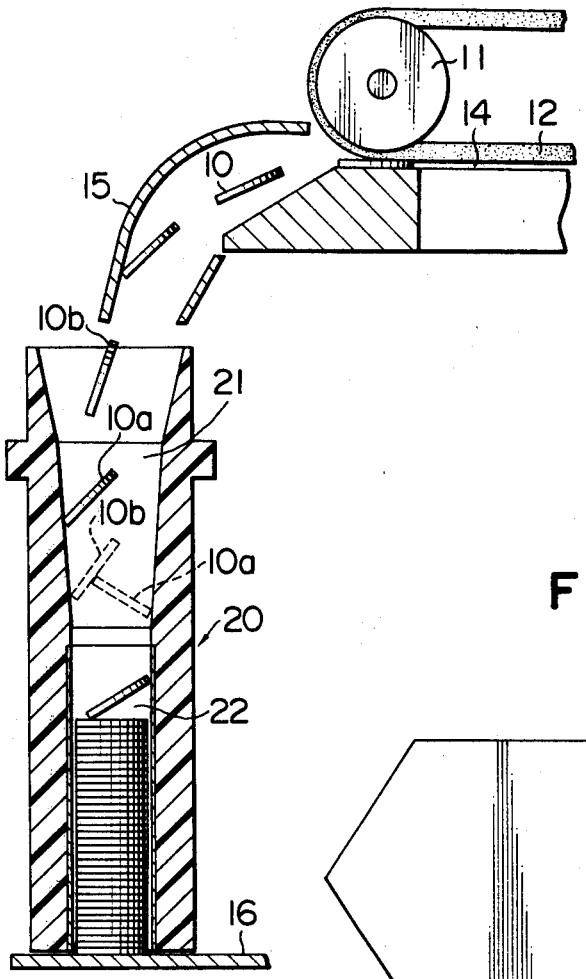
FIG. 1 PRIOR ART
FIG. 1 is a cross-sectional view showing a stacking cylinder of the prior art and associated members.

Referring to FIG. 1, there is shown a conventional stacking cylinder and associated members. Coins 10 are transferred within a coin path 14 by a transfer belt 12 trained on a pulley 11 and then discharged into a chute 15. The coins thus discharged are downwardly guided by the chute 15 into a stacking cylinder 20. Within the stacking cylinder, the coins first drop through an upper enlarged conical portion 21 of the stacking cylinder and then are stacked on a closed shutter 16 in a lower cylindrical portion 22 of the stacking cylinder. When a predetermined number of coins are correctly stacked in the stacking cylinder 20, the shutter 16 is opened and then the coins are supported by a supporting rod, not shown, so as to be transferred toward the next operating zone, for example, a coin wrapping zone.

In the above-mentioned conventional stacking cylinder, the coins guided by the chute 15 take various dropping paths since the chute cannot guide all coins in the same direction. For example, during the dropping, one coin 10*a* may first strike on one portion of the inner surface or wall of the stacking cylinder and then be rebounded from the portion toward the other opposite portion of the inner surface. In the meanwhile, a subsequent coin 10*b* may directly drop toward the bottom of the stacking cylinder. In such a case, as shown in dotted lines in FIG. 1, the subsequent coin 10*b* catches up with the preceding coin 10*a* and then these coins 10*a* and 10*b* interfere with each other, which results in the jamming of the coins within the stacking cylinder. If such a jamming occurs, the machine must be stopped to release the jammed coins.

Figure 2:
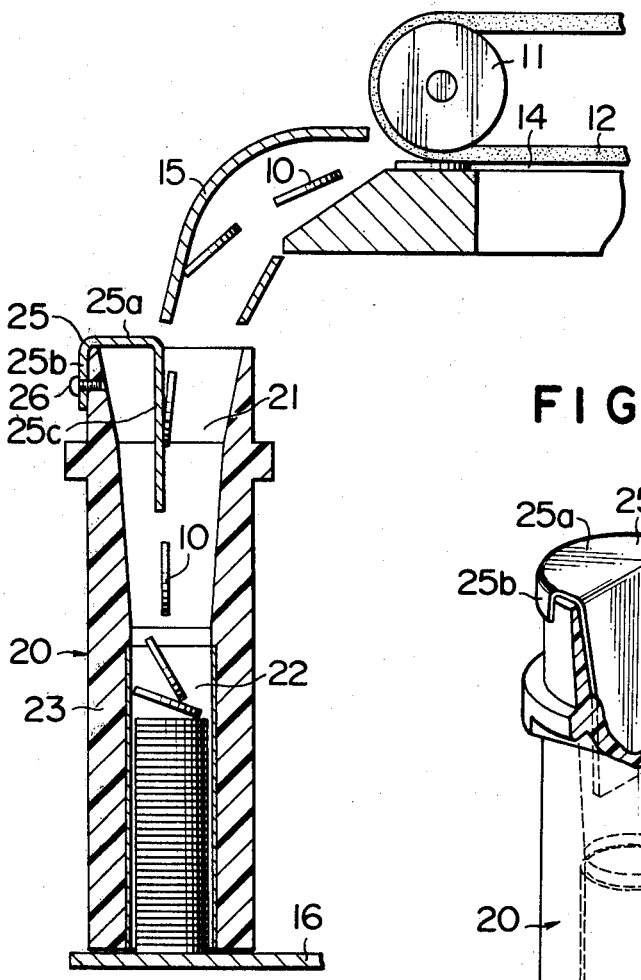
FIG. 2 is a cross-sectional view showing a stacking cylinder according to the invention and associated members.
Figure 3:
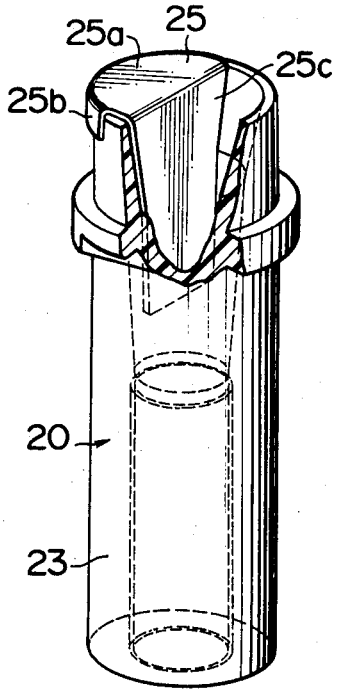
FIG. 3 is a perspective view showing the stacking cylinder of FIG. 2.

Referring now to FIGS. 2 and 3, there is shown a stacking cylinder 20 according to the invention. The stacking cylinder 20 includes a guide member 25 which is attached to the stacking cylinder at the top portion thereof. The guide member 25 comprises a semi-circular portion 25*a*, a mounting portion 25*b* for mounting the same on the stacking cylinder, and a suspended coin guide portion 25*c*. The portion 25*b* is provided with an aperture and is fixed on the stacking cylinder by a bolt 26 extending through the aperture. The guide portion 25*c* is of a flat rectangular configuration and arranged so that it is in alignment with the chute 15.

In the above construction, the coins discharged from the chute 15 are guided by the guide member 25 in a certain fixed direction toward the bottom of the stacking cylinder and do not interfere with each other during the dropping. That is, each coin is guided in the same direction and in the same attitude and therefore, the coins are stacked correctly in the stacking cylinder without jamming.

Figure 4:
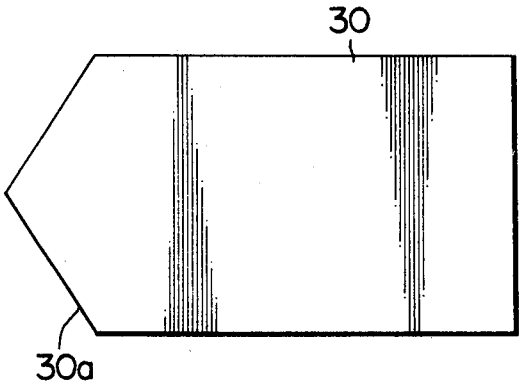
FIG. 4 is a front view showing a resilient metal sheet to be incorporated in the cylindrical body of the stacking cylinder.

Referring to FIG. 4, there is shown a metal sheet 30 of a resilient property which is to be assembled into a cylinder body 23 of the stacking cylinder 20 in place of a conventional preformed cylindrical metal sheet attached to the cylinder body by adhesive. The metal sheet 30 has a width adapted to be accommodated in the cylindrical recess 20*a* (FIG. 5) of the cylinder body 23. The length of the metal sheet 30 is selected so that when it is rolled up and assembled into the cylinder body its opposite edges are superposed. One of the edges 30*a* of the metal sheet is made to be of a chevron form.

Figure 5:
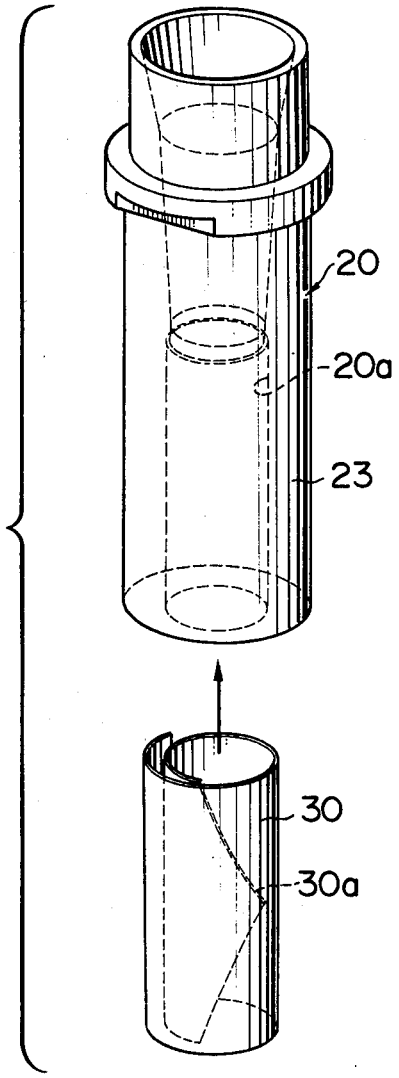
FIG. 5 is a perspective view showing the cylinder body and the rolled-up metal sheet, in the process of being assembled.

Referring to FIG. 5, the metal sheet 30 is rolled up by hand so that the chevron shaped edge of the metal plate is positioned inside the other straight edge. Then the rolled-up metal sheet is inserted into the cylindrical recess 20*a* formed inside the cylinder body 23 from the bottom side, as shown by an arrow. When the metal sheet has been completely inserted, it is released so as to be enlarged due to its resiliency and therefore, to be tightly engaged with the cylindrical recess 20*a*. That is, the metal sheet is mounted inside the cylinder body. At the time, the chevron shaped edge is superposed on the other edge. The chevron edge provides a gradually reduced pressure distribution to the other edge and thereby prevents a bending stress from concentrating on a line which would cause a bending on the other edge. The inside chevron edge has almost no effect on the smooth dropping of the coins.

Figure 6:
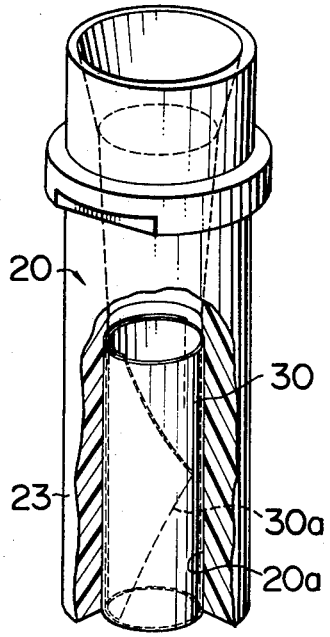
FIG. 6 is a perspective view, partially broken away, showing the assembled stacking cylinder.
Figure 7:
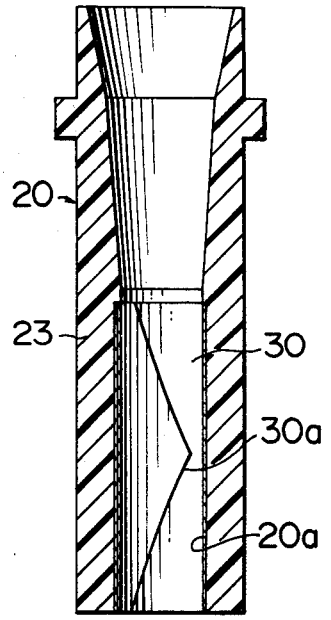
FIG. 7 is a cross-sectional view showing the assembled stacking cylinder of FIG. 6.

FIGS. 6 and 7, respectively, show the assembled stacking cylinder in a perspective view and a cross-sectional view wherein the rolled-up metal plate is incorporated in the cylinder body.

What is claimed is:

1. A stacking cylinder for use in a coin handling machine wherein coins are introduced into the stacking cylinder and stacked therein, said stacking cylinder comprising:

a cylinder body having a cylindrical recess formed therein; and a resilient metal sheet rolled into generally cylindrical form and inserted into the cylindrical recess formed inside the cylinder body, the rolled sheet being rigidly retained within the recess due to resiliency of the metal sheet so that coins are movable into and out of said stacking cylinder past said rolled sheet, said resilient metal sheet having a chevron shaped edge positioned inside the rolled sheet.

2. A stacking cylinder for use in a coin handling machine wherein coins are introduced into the stacking cylinder and stacked therein, said stacking cylinder comprising:

a cylinder body having a cylindrical recess formed therein; and a resilient metal sheet rolled into generally cylindrical form and inserted into the cylindrical recess formed inside the cylinder body, the rolled sheet being rigidly retained within the recess due to resiliency of the metal sheet so that coins are movable into and out of said stacking cylinder past said rolled sheet, said metal sheet having a length such that when it is inserted into the cylindrical recess opposite edges of the sheet are superposed and said metal sheet having a chevron shaped edge positioned inside the rolled sheet.

3. A stacking cylinder as set forth in claim 1 or 2, wherein the width of the metal sheet is substantially equal to the length of said cylindrical recess.

4. A stacking cylinder as set forth in claim 3, wherein said cylinder body as an enlarged conical portion extending upwardly and outwardly from said cylindrical recess.

* * * * *